US010892076B2

(12) United States Patent
Ito et al.

(10) Patent No.: US 10,892,076 B2
(45) Date of Patent: Jan. 12, 2021

(54) RARE EARTH MAGNET AND METHOD OF PRODUCING THE SAME

(71) Applicant: TOYOTA JIDOSHA KABUSHIKI KAISHA, Toyota (JP)

(72) Inventors: Masaaki Ito, Sunto-gun (JP); Noritsugu Sakuma, Mishima (JP); Tetsuya Shoji, Susono (JP); Hidefumi Kishimoto, Susono (JP); Masao Yano, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 240 days.

(21) Appl. No.: 15/832,173

(22) Filed: Dec. 5, 2017

(65) Prior Publication Data

US 2018/0182519 A1 Jun. 28, 2018

(30) Foreign Application Priority Data

Dec. 28, 2016 (JP) ..... 2016-256776
Jun. 21, 2017 (JP) ..... 2017-121398

(51) Int. Cl.
*H01F 1/057* (2006.01)
*H01F 41/02* (2006.01)
*H01F 41/00* (2006.01)

(52) U.S. Cl.
CPC ..... *H01F 1/0577* (2013.01); *H01F 41/005* (2013.01); *H01F 41/0293* (2013.01)

(58) Field of Classification Search
None
See application file for complete search history.

(56) References Cited

U.S. PATENT DOCUMENTS 4,765,848 A 8/1988 Mohri et al.
5,129,963 A 7/1992 Panchanathan et al.
(Continued)

FOREIGN PATENT DOCUMENTS

CN 105518809 A 4/2016
JP S61-159708 A 7/1986
(Continued)

OTHER PUBLICATIONS

U.S. Appl. No. 15/846,317, filed Dec. 19, 2017 in the name of Ito et al.
(Continued)

*Primary Examiner* — Xiaowei Su
(74) *Attorney, Agent, or Firm* — Oliff PLC

(57) ABSTRACT

A rare earth magnet includes a main phase, a grain boundary phase present around the main phase and an intermediate phase interposed between the main phase and the grain boundary phase, and has an overall composition that is represented by the formula $((Ce_{(1-x)}La_x)_{(1-y)}R^1_y)_pT_{(100-p-q-r)}B_qM^1_r(R^2_{1-z}M^2_z)_s$ (where, $R^1$ and $R^2$ are rare earth elements other than Ce and La, T is at least one selected from among Fe, Ni, and Co, $M^1$ is an element having a small amount that does not influence magnetic characteristics, and $M^2$ is an alloy element for which a melting point of $R^2_{1-z}M^2_z$ is lower than a melting point of $R^2$). A total concentration of Ce and La is higher in the main phase than in the intermediate phase, and a concentration of $R^2$ is higher in the intermediate phase than in the main phase.

16 Claims, 7 Drawing Sheets

(56) References Cited

U.S. PATENT DOCUMENTS

| | | | | | |
|---|---|---|---|---|---|
| RE34,838 | E * | 1/1995 | Mohri | H01F 1/0571 | |
| | | | | 148/302 | |
| 2005/0268989 | A1 | 12/2005 | Tomizawa et al. | | |
| 2015/0228386 | A1 | 8/2015 | Sakuma et al. | | |
| 2016/0141083 | A1* | 5/2016 | Ito | C22C 33/02 | |
| | | | | 252/62.55 | |
| 2018/0182515 | A1* | 6/2018 | Ito | C22C 1/0441 | |

FOREIGN PATENT DOCUMENTS

| | | | | |
|---|---|---|---|---|
| JP | H0421744 | A | 1/1992 | |
| JP | 4609644 | B2 | 1/2011 | |
| JP | 4618437 | B2 | 1/2011 | |
| JP | 2015-082626 | A | 4/2015 | |
| JP | 2016-111136 | A | 6/2016 | |
| JP | 6183457 | B2 | 8/2017 | |
| WO | 2014/196605 | A1 | 12/2014 | |
| WO | WO-2014196605 | A1 * | 12/2014 | H01F 1/0551 |

OTHER PUBLICATIONS

Jun. 24, 2020 Office Action issued in U.S. Appl. No. 15/846,317.
Apr. 20, 2020 Office Action issued in U.S. Appl. No. 15/846,317.
Oct. 8, 2020 Office Action issued in U.S. Appl. No. 15/846,317.

* cited by examiner

RARE EARTH MAGNET AND METHOD OF PRODUCING THE SAME

INCORPORATION BY REFERENCE

The disclosure of Japanese Patent Application No. 2017-121398 filed on Jun. 21, 2017 including the specification, drawings and abstract is incorporated herein by reference in its entirety.

BACKGROUND

1. Technical Field

The present disclosure relates to an R—Fe—B rare earth magnet (R is a rare earth element) and a method of producing the same. Particularly, the present disclosure relates to a (Ce, La)—Fe—B rare earth magnet and a method of producing the same.

2. Description of Related Art

Among R—Fe—B rare earth magnets, a Nd—Fe—B rare earth magnet is the most representative. Various attempts to improve specific characteristics of the Nd—Fe—B rare earth magnet have been made.

In a Nd—Fe—B rare earth sintered magnet, generally, anisotropy is imparted by strongly deforming a Nd—Fe—B rare earth magnet powder sintered material. Because a processing rate for strong deformation is extremely high at 30 to 70%, high thermal processability is necessary for the sintered material. In Japanese Unexamined Patent Application Publication No. 1992-21744 (JP 1992-21744 A), an attempt to improve thermal processability of a sintered material by replacing a part of Nd in a Nd—Fe—B rare earth sintered magnet with Ce, La, and/or Y is disclosed.

In addition, an attempt to improve a coercive force by causing permeation of a modifier containing a Nd—Cu alloy, a Nd—Cu—Dy alloy, and/or a Nd—Cu—Tb alloy into a Nd—Fe—B rare earth magnet has been made in the related art.

SUMMARY

The above-described modifier is nonmagnetic. In a Nd—Fe—B rare earth magnet, when a nonmagnetic modifier permeates between magnetic phases, the magnetic phases can be magnetically separated from each other. As a result, since it is possible to prevent magnetization reversal proceeding across a plurality of magnetic phases, the coercive force is improved.

However, when a content of a modifier in a Nd—Fe—B rare earth magnet increases, a content of a nonmagnetic material increases. Thus, when a modifier is provided between magnetic phases of a Nd—Fe—B rare earth magnet, magnetization is generally reduced.

Accordingly, the inventors found that there is a demand for preventing magnetization from being reduced even when a coercive force is improved by causing permeation of a modifier into a rare earth magnet.

The present disclosure provides a rare earth magnet in which magnetization is able to be prevented from being reduced when a coercive force is improved by causing permeation of a modifier thereinto and a method of producing the same.

The inventors conducted extensive research and realized a rare earth magnet and a method of producing the same of the present disclosure. A first aspect of the present disclosure relates to a rare earth magnet which includes a main phase, a grain boundary phase present around the main phase, and an intermediate phase interposed between the main phase and the grain boundary phase.

The rare earth magnet has an overall composition represented by $((Ce_{(1-x)}La_x)_{(1-y)}R^1_y)_pT_{(100-p-q-r)}B_qM^1_r(R^2_{1-z}M^2_z)_s$, $R^1$ and $R^2$ are rare earth elements other than Ce and La, T is at least one selected from among Fe, Ni, and Co, $M^1$ is at least one selected from among Ti, Ga, Zn, Si, Al, Nb, Zr, Mn, V, W, Ta, Ge, Cu, Cr, Hf, Mo, P, C, Mg, Hg, Ag, and Au, and first inevitable impurities, $M^2$ is (i) an alloy element for which a melting point of $R^2_{1-z}M^2_z$ is lower than a melting point of $R^2$ when it is alloyed with $R^2$ and (ii) second inevitable impurities, and p, q, r, s, x, y, and z satisfy $12.0 \le p \le 20.0$,
$5.0 \le q \le 20.0$,
$0 \le r \le 3.0$,
$1.0 \le s \le 11.0$,
$0.1 \le x \le 0.5$,
$0 \le y \le 0.1$, and
$0.1 \le z \le 0.5$.

A total concentration of Ce and La is higher in the main phase than in the intermediate phase. A concentration of $R^2$ is higher in the intermediate phase than in the main phase.

A concentration of La may be higher in the grain boundary phase than in the intermediate phase.

$R^2$ may be at least one selected from among Nd, Pr, Dy, and Tb.

The total concentration of Ce and La in the main phase may be 1.5 to 10.0 times as high as that in the intermediate phase.

The concentration of $R^2$ in the intermediate phase may be 1.5 to 10.0 times as high as that in the main phase.

A concentration of La in the grain boundary phase may be 1.5 to 10.0 times as high
as that in the intermediate phase.

x may satisfy $0.2 \le x \le 0.3$.

z may satisfy $0.2 \le z \le 0.4$.

A thickness of the intermediate phase may be 5 to 50 nm.

T may be Fe.

A second aspect of the present disclosure relates to a method of producing a rare earth magnet. The method includes preparing a rare earth magnet precursor which has an overall composition represented by $((Ce_{(1-x)}La_x)_{(1-y)}R^1_y)_pT_{(100-p-q-r)}B_qM^1_r$, and includes a magnetic phase and a (Ce, La, $R^1$)-rich phase present around the magnetic phase, where $R^1$ is a rare earth element other than Ce and La, T is at least one selected from among Fe, Ni, and Co, $M^1$ is at least one selected from among Ti, Ga, Zn, Si, Al, Nb, Zr, Mn, V, W, Ta, Ge, Cu, Cr, Hf, Mo, P, C, Mg, Hg, Ag, and Au, and first inevitable impurities, and p, q, r, x and y satisfy $12.0 \le p \le 20.0$,
$5.0 \le q \le 20.0$,
$0 \le r \le 3.0$,
$0.1 \le x \le 0.5$, and
$0 \le y \le {}^0 0.1$, preparing a modifier containing an alloy represented by $R^2_{1-z}M^2_z$, where $R^2$ is a rare earth element other than Ce and La, and $M^2$ is (i) an alloy element for which a melting point of $R^2_{1-z}M^2_z$ is lower than a melting point of $R^2$ when it is alloyed with $R^2$ and (ii) second inevitable impurities, and $0.1 \le z \le 0.5$, bringing the rare earth magnet precursor and the modifier into contact with each other to obtain a contact body; and heating the contact body such that a liquid which is the melted modifier is permeated into the magnetic phase of the rare earth magnet precursor in a heat treatment.

$R^2$ may be at least one selected from among Nd, Pr, Dy, and Tb, and the $M^2$ may be at least one selected from among Cu, Al, and Co, and inevitable impurities.

z may satisfy $0.2 \leq z \leq 0.4$.

A permeation amount of the modifier may be 1.0 to 11.0 atom % with respect to the rare earth magnet precursor.

A temperature in the heat treatment may be 600 to 800° C.

x may satisfy $0.2 \leq x \leq 0.3$.

T may be Fe.

According to the present disclosure, it is possible to provide a rare earth magnet and a method of producing the same through which, when Ce and La are included together, even if the coercive force is improved by causing permeation of a modifier, it is possible to prevent magnetization from being reduced.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
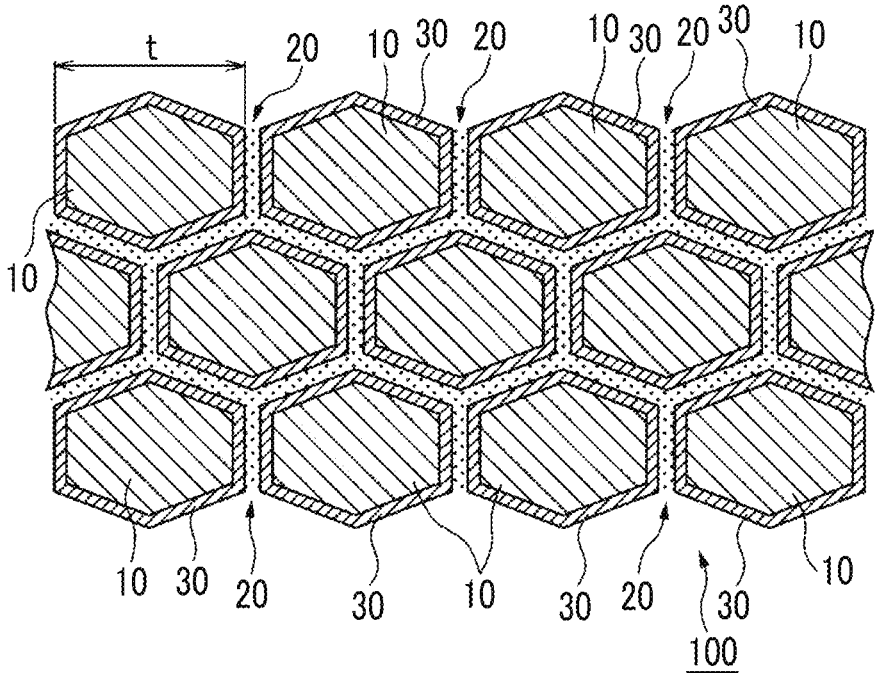
FIG. 1 is a diagram schematically showing a structure of a rare earth magnet of the present disclosure.

A rare earth magnet and a method of producing the same according to embodiments of the present disclosure will be described below in detail. Here, the following embodiments do not limit the rare earth magnet and the method of producing the same according to the present disclosure.

An R—Fe—B rare earth magnet is obtained by liquid quenching of a molten material of an R—Fe—B alloy. Due to liquid quenching or the like, a magnetic phase represented by $R_2Fe_{14}B$ (hereinafter such a phase will be referred to as an "$R_2Fe_{14}B$ phase") is formed. In the residual liquid after the $R_2Fe_{14}B$ phase is formed, an R-rich phase is formed by excess R that did not contribute to formation of the $R_2Fe_{14}B$ phase. The R-rich phase is formed around the $R_2Fe_{14}B$ phase.

When a modifier permeates into the R—Fe—B rare earth magnet, an alloy in the modifier mainly contains the same rare earth element as in the $R_2Fe_{14}B$ phase, and the rare earth element in the modifier does not easily permeate into the $R_2Fe_{14}B$ phase. For example, when a modifier containing a Nd—Cu alloy permeates into a Nd—Fe—B rare earth magnet, Nd in the modifier is likely to remain in the Nd rich phase and does not easily permeate into a $Nd_2Fe_{14}B$ phase.

On the other hand, when an alloy in the modifier mainly contains a rare earth element different from that in the $R_2Fe_{14}B$ phase, the rare earth element in the modifier easily permeates into the $R_2Fe_{14}B$ phase. For example, when a modifier containing a Dy—Cu alloy permeates into a Nd—Fe—B rare earth magnet, Dy in the modifier easily permeates into the $Nd_2Fe_{14}B$ phase.

The inventors found that, when R in the $R_2Fe_{14}B$ phase is mainly Ce and La and the modifier mainly contains a rare earth element other than Ce and La, the rare earth element of the alloy in the modifier particularly easily permeates into the $R_2Fe_{14}B$ phase.

The inventors found that, despite permeation of the non-magnetic modifier in such a case a reduction in magnetization is prevented and the coercive force is improved.

Based on such findings, a configuration of a rare earth magnet according to the present disclosure will be described below.

(Overall Composition)

The overall composition of the rare earth magnet of the present disclosure is represented by the formula $((Ce_{(1-x)}La_x)_{(1-y)}R^1_y)_pT_{(100-p-q-r)}B_qM^1_r(R^2_{1-z}M^2_z)_s$.

In the formula, $R^1$ and $R^2$ are rare earth elements other than Ce and La. T is at least one selected from among Fe, Ni, and Co. $M^1$ is at least one selected from among Ti, Ga, Zn, Si, Al, Nb, Zr, Mn, V, W, Ta, Ge, Cu, Cr, Hf, Mo, P, C, Mg, Hg, Ag, and Au, and inevitable impurities. $M^2$ is an alloy element and inevitable impurities for which a 5 melting point of $R^2$ is lowered.

p is a total content of Ce, La, and $R^1$, q is a content of B (boron), r is a content of $M^1$, and s is a total content of $R^2$ and $M^2$. p, q, r, and s have a value in atom %.

x indicates proportions of contents of Ce and La. y indicates proportions of a total content of Ce and La and a content of $R^1$. z indicates proportions of contents of $R^2$ and $M^2$. x, y, and z are a value of a molar ratio.

As will be described below, the rare earth magnet of the present disclosure is obtained by permeating a modifier into a rare earth magnet precursor. The rare earth magnet precursor has an overall composition represented by the formula $((Ce_{(1-x)}La_x)_{(1-y)}R^1_y)_pT_{(100-p-q-r)}B_qM^1_r$. The modifier contains an alloy having a composition represented by $R^2_{1-z}M^2_z$.

An amount of an alloy permeating into the rare earth magnet precursor is s atom %, that is, 1.0 to 11.0 atom %. Here, the overall composition of the rare earth magnet of the present disclosure is a combination of a composition represented by $((Ce_{(1-x)}La_x)_{(1-y)}R^1_y)_pT_{(100-p-q-r)}B_qM^1_r$ and a composition represented by $(R^2_{1-z}M^2_z)_s$. The combined composition is represented by the formula $((Ce_{(1-x)}La_x)_{(1-y)}R^1_y)_pT_{(100-p-q-r)}B_qM^1_r(R^2_{1-z}M^2_z)_s$.

In order for the rare earth magnet precursor to include an appropriate amount of a phase represented by $((Ce_{(1-x)}La_x)_{(1-y)}R^1_y)_2T_{(100-p-q-r)14}B$, the relations $12.0 \leq p \leq 20.0$ and $5.0 \leq q \leq 20.0$ should be satisfied. In addition, $M^1$ can be included in a range in which characteristics of the rare earth magnet of the present disclosure do not deteriorate. $M^1$ may contain inevitable impurities. The inevitable impurities are impurities that are inevitably contained or of which avoiding inclusion would cause a significant increase in production costs, such as impurities contained in raw materials. When r is 3.0 or less, characteristics of the rare earth magnet of the present disclosure do not deteriorate. Values of p, q, and r are the same as those in a general R—Fe—B rare earth magnet.

T is classified as an iron group element, and Fe, Ni, and Co have a common property that ferromagnetism is exhibited at normal temperature and at normal pressure. Thus, they may be interchangeably used. When Co is contained, magnetization is improved and the Curie point increases. This effect is exhibited when a Co content is 0.1 atom % or more. In consideration of such an effect, a Co content is preferably 0.1 atom % or more, more preferably 1 atom % or more, and most preferably 3 atom % or more. On the other hand, since Co is expensive and Fe is the cheapest, economically, there is preferably 80 atom % or more, and more preferably 90 atom % or more of Fe with respect to all T, and all T may be Fe.

(Main Phase, Grain Boundary Phase, and Intermediate Phase)

Next, a structure of a rare earth magnet of the present disclosure having an overall composition represented by the above formula will be described. FIG. 1 is a diagram schematically showing a structure of the rare earth magnet of the present disclosure. A rare earth magnet 100 includes a main phase 10, a grain boundary phase 20, and an intermediate phase 30.

In order to ensure a coercive force, the average particle size of the main phase 10 is preferably as small as possible, and is preferably 1000 nm or less and more preferably 500 nm or less. On the other hand, in practice, the average particle size of the main phase 10 may be 1 nm or more, 50 nm or more, or 100 nm or more.

Here, the "average particle size" is, for example, an average value of lengths (t) of the main phases 10 shown in FIG. 1 in the longitudinal direction. For example, in a scanning electron microscope image or a transmission electron microscope image of the rare earth magnet 100, a certain area is defined, an average value of lengths (t) of the main phases 10 present in the certain area is calculated, and this is used as an "average particle size." When the cross-sectional shape of the main phase 10 is elliptical, a length of the major axis is set as t. When the cross section of the main phase is rectangular, a length of a longer diagonal line is set as t.

The rare earth magnet 100 may contain phases (not shown) other than the main phase 10, the grain boundary phase 20, and the intermediate phase 30. As phases other than the main phase 10, the grain boundary phase 20, and the intermediate phase 30, oxides, nitrides, intermetallic compounds, and the like may be exemplified.

The characteristics of the rare earth magnet 100 exhibited are mainly due to the main phase 10, the grain boundary phase 20, and the intermediate phase 30. Most of the phases other than the main phase 10, the grain boundary phase 20, and the intermediate phase 30 are impurities. Thus, a total content of the main phase 10, the grain boundary phase 20, and the intermediate phase 30 with respect to the rare earth magnet 100 is preferably 95 volume % or more, more preferably 97 volume % or more, and most preferably 99 volume % or more.

Figure 2:
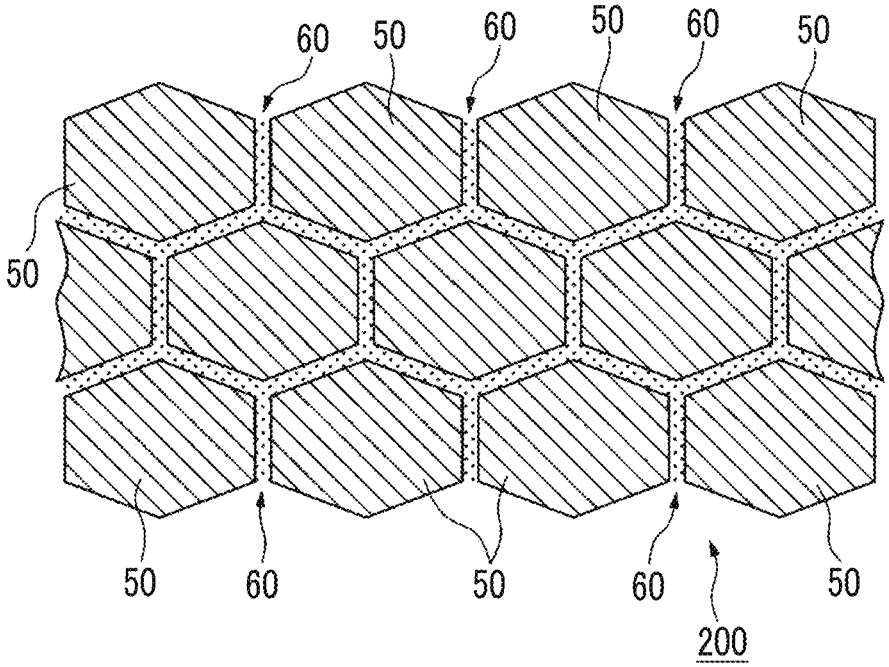
FIG. 2 is a diagram schematically showing a structure of a rare earth magnet precursor.

The rare earth magnet precursor has a composition represented by the formula $((Ce_{(1-x)}La_x)_{(1-y)}R^1{}_y)_pT_{(100-p-q-r)}B_qM^1{}_r$. FIG. 2 is a diagram schematically showing a structure of a rare earth magnet precursor. A rare earth magnet precursor 200 has a magnetic phase 50 (hereinafter referred to as "magnetic phase 50" in some cases) represented by $((Ce_{(1-x)}La_x)_{(1-y)}R^1{}_y)_2T_{14}B$. The magnetic phase 50 is a granular crystal phase. A (Ce, La, $R^1$)-rich phase 60 is present around the magnetic phase 50. The (Ce, La, $R^1$)-rich phase 60 is formed of elements that did not contribute to formation of the magnetic phase 50, and concentrations of Ce, La, and $R^1$ therein are high.

When the modifier permeates into the rare earth magnet precursor 200, the modifier passes through the (Ce, La, $R^1$)-rich phase 60 and reaches an interface between the (Ce, La, $R^1$)-rich phase 60 and the magnetic phase 50. Then, some of $R^2$ in the modifier permeates from the (Ce, La, $R^1$)-rich phase 60 into the magnetic phase 50, and Ce and La move from the magnetic phase 50 into the (Ce, La, $R^1$)-rich phase 60. As a result, the main phase 10, the grain boundary phase 20, and the intermediate phase 30 are formed in the rare earth magnet 100.

The grain boundary phase 20 is present around the main phase 10. The intermediate phase 30 is interposed between the main phase 10 and the grain boundary phase 20. Thus, a total concentration of Ce and La is higher in the main phase 10 than in the intermediate phase 30. In addition, a concentration of $R^2$ is higher in the intermediate phase 30 than in the main phase 10.

Since Ce and La are light rare earth elements, when Ce and La in the magnetic phase are replaced with a rare earth element $R^2$ other than Ce and La, it is possible to increase an anisotropic magnetic field. Since a concentration of $R^2$ is higher in the intermediate phase 30 than in the main phase 10, the anisotropic magnetic field is larger in the intermediate phase 30 (a peripheral part of the magnetic phase) than in the main phase 10 (a center part of the magnetic phase). Thus, the main phases 10 which are magnetic phases are magnetically separated more strongly by the intermediate phase 30 being additional to the grain boundary phase 20. Accordingly, the coercive force is improved. Here, the anisotropic magnetic field is a physical property value that represents a magnitude of a coercive force of a permanent magnet.

When $R^2$ is at least one selected from among Nd, Pr, Dy, and Tb, the coercive force is further improved. This is because Nd, Pr, Dy, and Tb can increase the anisotropic magnetic field more than other rare earth elements.

When the intermediate phase 30 is excessively thin, the anisotropic magnetic field is lower and the coercive force decreases. In consideration of such an effect, the thickness of the intermediate phase 30 is preferably 2 nm or more, more preferably 10 nm or more, and most preferably 20 nm or more. Here, the sensitivity of the thickness of the intermediate phase 30 with respect to the magnetization depends on $R^2$. When a saturation magnetization (a physical property value that represents a magnitude of magnetization of a permanent magnet) of $R^2$ is larger than that of La and/or Ce (Nd and/or Pr), the intermediate phase 30 is excessively thin, and magnetization is lowered. In consideration of such an effect, the thickness of the intermediate phase 30 is preferably 2 nm or more, more preferably 10 nm or more, and most preferably 20 nm or more. On the other hand, when the saturation magnetization of $R^2$ is lower than that of La and/or Ce (Dy and/or Tb), the intermediate phase 30 is excessively thin and magnetization is lowered. In consideration of such an effect, the thickness of the intermediate phase 30 is preferably 50 nm or less, more preferably 40 nm or less, and most preferably 30 nm or less.

When a concentration of $R^2$ (a peripheral part of the magnetic phase) in the intermediate phase 30 is 1.5 times as high as that in the main phase 10 (a center part of the magnetic phase) or more, magnetic separation can be more clearly recognized. On the other hand, when a concentration of $R^2$ in the intermediate phase 30 (a peripheral part of the magnetic phase) is 10.0 times as high as that in the main phase 10 (a center part of the magnetic phase), an effect of magnetic separation is not maximized. Thus, a concentration of $R^2$ in the intermediate phase 30 is preferably 1.5 to 10.0 times as high as that in the main phase 10, more preferably 1.5 to 5.0 times, and most preferably 1.5 to 3.0 times.

In addition, when the intermediate phase is formed, in order for more $R^2$ to permeate into the intermediate phase 30, it is preferable that more Ce and La be moved from the intermediate phase 30 to the grain boundary phase 20. Since it takes time for $R^2$ to reach the main phase 10, when more Ce and La move from the intermediate phase 30 to the grain boundary phase 20, a total concentration of Ce and La is higher in the main phase 10 than in the intermediate phase 30. When a total concentration of Ce and La in the main phase 10 is 1.5 times as high as that in the intermediate phase 30 or more, it is possible to recognize permeation of more $R^2$ more clearly. On the other hand, when a total concentration of Ce and La in the main phase 10 is 10.0 times as high as that in the intermediate phase 30, permeation of $R^2$ is not maximized (saturated). Thus, a total concentration of Ce and La in the main phase 10 is preferably 1.5 to 10.0 times as high as that in the intermediate phase 30, more preferably 1.5 to 5.0 times, and most preferably 1.5 to 3.0 times.

When Ce and La are included together in the magnetic phase 50, mutual movement of Ce and La with respect to $R^2$ at an interface between the (Ce, La, $R^1$)-rich phase 60 and the magnetic phase 50 occurs more easily than when Ce is included without La. Thus, when Ce and La are included together in the magnetic phase 50, much Ce and La move from the magnetic phase 50 to the (Ce, La, $R^1$)-rich phase 60, and much $R^2$ moves from the (Ce, La, $R^1$)-rich phase 60 to the magnetic phase 50. As a result, the main phase 10 and the intermediate phase 30 are formed, a total concentration of Ce and La is higher in the main phase 10 than in the intermediate phase 30, and a concentration of $R^2$ is higher in the intermediate phase 30 than in the main phase 10. In the following description, when Ce and La are included together in the magnetic phase 50, if mutual movement of Ce and La with respect to $R^2$ at an interface between the (Ce, La, $R^1$)-rich phase 60 and the magnetic phase 50 occurs, this is referred to as "mutual movement of Ce and La with respect to $R^2$ at an interface."

When an amount of rare earth elements $R^1$ other than Ce and La is smaller in the magnetic phase 50, mutual movement of Ce and La with respect to $R^2$ at an interface easily occurs.

In the above formula, y is an allowable amount of rare earth elements $R^1$ other than Ce and La in the magnetic phase 50. y is preferably as small as possible, and is ideally 0. However, in order to avoid an excessive increase in production costs of a raw material, a lower limit of y may be 0.03. On the other hand, when y is 0.1 or less, even if mutual movement of Ce and La with respect to $R^2$ is obstructed, there is substantially no problem. In consideration of such an effect, y is preferably 0.05 or less.

Ce and La are included together according to a formulation ratio represented by $Ce_{(1-x)}La_x$. When x is 0.1 or more, an effect of facilitating mutual movement of Ce and La with respect to $R^2$ at an interface is exhibited. This effect is maximized when x is between 0.1 and 0.3. When x is 0.5 or less, an effect stronger than when the effect is exhibited can be obtained. Accordingly, x is preferably 0.2 or more. In addition, x is preferably 0.4 or less and more preferably 0.3 or less.

Figure 3:
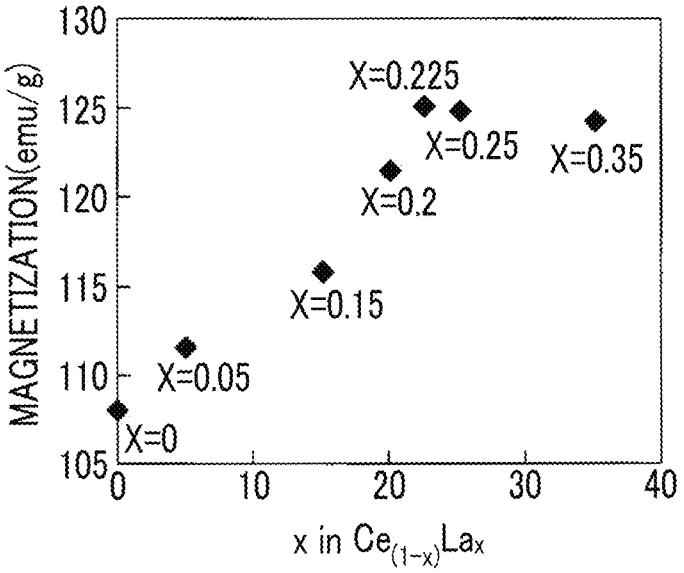
FIG. 3 is a graph showing a relationship between x in a rare earth magnet precursor having an overall composition represented by $((Ce_{(1-x)}La_x)_{(1-y)}R^1_y)_pT_{(100-p-q-r)}B_qM^1_r$ and magnetization.

FIG. 3 is a graph showing a relationship between x in the rare earth magnet precursor 200 having an overall composition represented by $((Ce_{(1-x)}La_x)_{(1-y)}R^1_y)_pT_{(100-p-q-r)}B_qM^1_r$ and magnetization. As can be understood from FIG. 3, when x is in the above range, magnetization is improved in the rare earth magnet precursor 200 before permeation of the modifier. This is favorable because a reduction in magnetization is prevented even if the coercive force is improved by causing permeation of a modifier.

While not being bound by this theory, when Ce and La are included together, the following is further assumed. The magnetization and the coercive force of the main phase 10 and the intermediate phase 30, and replacement of Ce and La with $R^2$ will be described separately.

First, the magnetization and the coercive force of the main phase 10 and the intermediate phase 30 will be described. Many Ce atoms are tetravalent in a magnetic phase represented by $Ce_2Fe_{14}B$. In tetravalent Ce, *4f* electrons are not localized. Since 4f electrons contribute to improvement of magnetization, but 4f electrons are not localized in tetravalent Ce, the magnetization is thus thought to be lowered. Here, when La is added to the magnetic phase to prepare a magnetic phase represented by $(Ce, Nd)_2Fe_{14}B$, the valency of many Ce becomes trivalent. Since 4f electrons are localized in trivalent Ce, magnetization is improved. That is, when Ce and La are included together, magnetization of the main phase 10 and the intermediate phase 30 is improved. In addition, when the modifier permeates, Ce and La in the intermediate phase 30 are replaced with $R^2$, and the intermediate phase 30 has a larger anisotropic magnetic field than the main phase 10. Thus, adjacent main phases 10 are magnetically separated, and thus the coercive force is improved.

Next, replacement of Ce and La with $R^2$ will be described. A lattice stabilization energy of $La_2Fe_{14}B$ is lower than a lattice stabilization energy of $Ce_2Fe_{14}B$. Thus, a lattice stabilization energy of $(Ce, La)_2Fe_{14}B$ is lower than a lattice stabilization energy of $Ce_2Fe_{14}B$. Accordingly, when Ce and La are included together, compared to when Ce is included without La, mutual movement of Ce and La with respect to $R^2$ at the above interface occurs more easily, and $R^2$ can easily be replaced with La and/or Ce in $La_2Fe_{14}B$ and/or $Ce_2Fe_{14}B$. Since mutual movement of Ce and La with respect to $R^2$ occurs easily, a concentration of $R^2$ is thought to be higher in the intermediate phase 30 than in the main phase 10. In addition, when Nd ($R^2$) is replaced with La and/or Ce, it is possible to prevent magnetization from being reduced. Further, in the relationship between the grain boundary phase 20 and the intermediate phase 30, since the lattice stabilization energy of $La_2Fe_{14}B$ is lower than the lattice stabilization energy of $Ce_2Fe_{14}B$, any $La_2Fe_{14}B$ is hardly included in the intermediate phase 30 and La is easily moved to the grain boundary phase 20. Thus, a concentration of La is higher in the grain boundary phase 20 than in the intermediate phase 30. As a result, because Nd ($R^2$) is replaced with $La_2Fe_{14}B$, it is possible to prevent magnetization from being reduced. In addition, a concentration of Nd ($R^2$) in the intermediate phase 30 increases, and the anisotropic magnetic field is larger, thereby contributing to improvement in the coercive force.

A concentration of La in the grain boundary phase 20 may be 1.5 times or more, 3.0 times or more, or 4.5 times or more, or 10.0 times or less, 8.5 times or less, or 7.0 times or less as high as that in the intermediate phase 30.

Accordingly, in the rare earth magnet of the present disclosure, even if the coercive force is improved by causing permeation of a modifier, it is possible to prevent magnetization from being reduced.

(Production Method)

Next, a method of producing a rare earth magnet of the present disclosure will be described.

(Preparation of Rare Earth Magnet Precursor)

The rare earth magnet precursor 200 having an overall composition represented by the formula $((Ce_{(1-x)}La_x)_{(1-y)}R^1_y)_pT_{(100-p-q-r)}B_qM^1_r$ is prepared. $R^1$, T, $M^1$, and p, q, r, x, and y are the same as those described above.

The rare earth magnet precursor 200 may be a magnetic powder or a magnetic powder sintered material, and may be a plastically deformed component obtained by performing high temperature deformation on a sintered material.

As a method of producing a magnetic powder, known methods can be used. For example, a method of obtaining an isotropic magnetic powder having a nanocrystalline structure using a liquid quenching method may be exemplified. Alternatively, there is a method of obtaining an isotropic or anisotropic magnetic powder using a hydrogen disproportionation desorption recombination (HDDR) technique.

A method of obtaining a magnetic powder using the liquid quenching method will be generally described. An alloy having the same composition as the overall composition of the rare earth magnet precursor 200 is melted at a high frequency to prepare a molten material. For example, in an Ar gas atmosphere in which a pressure is reduced to 50 kPa or less, a molten material may be discharged to a copper single roller to prepare a quenched strip. The quenched strip may be pulverized to, for example, 10 μm or less.

Next, a method of obtaining a sintered material will be generally described. A magnetic powder obtained by pulverization is oriented in a magnetic field and is subjected to liquid phase sintering to obtain an anisotropic sintered material. Alternatively, a magnetic powder having an isotropic nanocrystalline structure obtained using a liquid quenching method may be sintered to obtain an isotropic sintered material. Alternatively, a magnetic powder having an isotropic nanocrystalline structure may be sintered and additionally a sintered material may be strongly deformed to obtain a plastically deformed component having anisotropy. Alternatively, an isotropic or anisotropic magnetic powder obtained using an HDDR technique may be sintered to obtain an isotropic or anisotropic sintered material.

(Preparation of Modifier)

A modifier containing an alloy having a composition represented by $R^2_{1-z}M^2_z$ is prepared. $R^2$ is a rare earth element other than Ce and La. $M^2$ is an alloy element and inevitable impurities for which a melting point of $R^2_{1-z}M^2_z$ is lower than a melting point of $R^2$ when it is alloyed with $R^2$. Proportions of $R^2$ and $M^2$ are such that $0.1 \leq z \leq 0.5$.

The magnetic phase 50 of the rare earth magnet precursor 200 mainly contains Ce and La, and $R^2$ is a rare earth element other than Ce and La. Therefore, in a heat treatment to be described below, $R^2$ in a liquid in which the modifier is melted permeates easily into the magnetic phase 50 of the rare earth magnet precursor 200. As a result, the main phase 10 and the intermediate phase 30 which contain $R^2$ are obtained.

When $R^2$ is at least one selected from among Nd, Pr, Dy, and Tb, the coercive force is further improved. This is because Nd, Pr, Dy, and Tb can increase the anisotropic magnetic field more than other rare earth elements. Accordingly, $R^2$ is preferably at least one selected from among Nd, Pr, Dy, and Tb.

Since $M^2$ is an alloy element and inevitable impurities for which a melting point of $R^2_{1-z}M^2_z$ is lower than a melting point of $R^2$ when $M^2$ is alloyed with $R^2$, it is possible to melt an alloy in the modifier without excessively increasing a temperature in the heat treatment to be described below. As a result, the modifier can permeate into the rare earth magnet precursor 200 without coarsening a structure of the rare earth magnet precursor 200. $M^2$ may contain inevitable impurities. The inevitable impurities are impurities that are inevitably contained or of which avoiding inclusion would cause a significant increase in production costs, such as impurities contained in raw materials.

$M^2$ is preferably at least one selected from among Cu, Al, and Co, and inevitable impurities. This is because Cu, Al, and Co have little adverse effect on magnetic characteristics and the like of the rare earth magnet.

As alloys of $R^2$ and $M^2$, Nd—Cu alloys, Pr—Cu alloys, Tb—Cu alloys, Dy—Cu alloys, La—Cu alloys, Ce—Cu alloys, Nd—Pr—Cu alloys, Nd—Al alloys, Pr—Al alloys, Nd—Pr—Al alloys, Nd—Co alloys, Pr—Co alloys, Nd—Pr—Co alloys, and the like may be exemplified.

Proportions of $R^2$ and $M^2$ will be described. When z is 0.1 or more, since a melting point of the alloy in the modifier is appropriately lowered, a temperature in the heat treatment to be described below is appropriate. As a result, it is possible to prevent coarsening of the structure of the rare earth magnet precursor 200. In consideration of optimization of the melting point of the alloy, z is preferably 0.2 or more and more preferably 0.25 or more. On the other hand, when z is 0.5 or less, since a content of $R^2$ in the alloy is large, $R^2$ easily permeates into the main phase 10 and the intermediate phase 30. In consideration of such an effect, z is preferably 0.4 or less and more preferably 0.35 or less. When $R^2$ is two or more elements, a sum thereof applies. This similarly applies to $M^2$ A method of producing a modifier is not particularly limited. As a method of producing a modifier, a casting method, a liquid quenching method, and the like may be exemplified. The liquid quenching method is preferable because variation of alloy components according to a part of the modifier is small and an amount of impurities such as oxides is small.

(Preparation of Contact Body)

The rare earth magnet precursor 200 and the modifier are brought into contact with each other to obtain a contact body. When both the rare earth magnet precursor 200 and the modifier are a bulk body, at least one surface of the rare earth magnet precursor 200 and at least one surface of the modifier are brought into contact with each other. A bulk body includes an agglomerate, a plate material, a strip, pressurized powder, a sintered material, and the like. For example, when both the rare earth magnet precursor 200 and the modifier are a strip, one surface of the rare earth magnet precursor 200 and one surface of the strip may be brought into contact with each other, the rare earth magnet precursor 200 may be interposed between the modifiers, and the modifier may be brought into contact with both surfaces of the rare earth magnet precursor.

When the rare earth magnet precursor 200 is a bulk body and the modifier is a powder, the powder of the modifier may be brought into contact with at least one surface of the rare earth magnet precursor 200. Typically, the powder of the modifier may be provided on the upper surface of the rare earth magnet precursor 200.

When both the rare earth magnet precursor 200 and the modifier are powders, the respective powders may be mixed with each other.

(Heat Treatment)

The above contact body is heated and a liquid in which the modifier is melted permeates into the rare earth magnet precursor 200. Thus, a liquid in which the modifier is melted reaches the magnetic phase 50 of the rare earth magnet precursor 200 through the (Ce, La, $R^1$)-rich phase 60 of the rare earth magnet precursor 200 and forms the main phase 10 and the intermediate phase 30 of the rare earth magnet 100.

A permeation amount of the modifier is preferably 1.0 to 11.0 atom % with respect to the rare earth magnet precursor 200. If even a small amount of the modifier permeates into the rare earth magnet precursor 200, the rare earth magnet 100 of the present disclosure is obtained. When a permeation amount of the modifier is 1.0 atom % or more, the effects of the rare earth magnet 100 of the present disclosure can be clearly recognized. In consideration of such an effect, a permeation amount of the modifier is preferably 2.6 atom % or more, more preferably 4.0 atom % or more, and most preferably 5.0 atom % or more. On the other hand, when a permeation amount of the modifier is 11.0 atom % or less, the effect of permeation of the modifier is not maximized. In consideration of such an effect, a permeation amount of the modifier is preferably 8.0 atom % or less and more preferably 7.5 atom % or less.

A temperature in the heat treatment is not particularly limited as long as the modifier is melted and a liquid in which the modifier is melted can permeate into the magnetic phase 50 of the rare earth magnet precursor 200.

When a temperature in the heat treatment is higher, a liquid in which the modifier is melted, and particularly, $R^2$, may easily permeate into the magnetic phase 50 of the rare earth magnet precursor 200. In consideration of such an effect, a temperature in the heat treatment is preferably 600° C. or more, more preferably 625° C. or more, and most preferably 675° C. or more. On the other hand, when a temperature in the heat treatment is lower, coarsening of the structure of the rare earth magnet precursor 200, and particularly, the magnetic phase 50, is easily prevented. In consideration of such an effect, a temperature in the heat treatment is preferably 800° C. or less, more preferably 775° C. or less, and most preferably 725° C. or less.

A heat treatment atmosphere is not particularly limited. However, in order to prevent oxidation of the rare earth magnet precursor 200 and the modifier, an inert gas atmosphere is preferable. The inert gas atmosphere includes a nitrogen gas atmosphere.

The rare earth magnet of the present disclosure and the method of producing the same will be described below in further detail with reference to examples. Here, the rare earth magnet of the present disclosure and the method of producing the same are not limited to conditions used in the following examples.

(Preparation of Sample of Example 1)

First, the rare earth magnet precursor 200 was prepared. A molten material of an alloy having a composition represented by $(Ce_{0.75}La_{0.25})_{12.47}Fe_{81.23}Cu_{0.20}B_{5.73}Ga_{0.37}$ was liquid-quenched by a single roller method to obtain a strip. As liquid quenching conditions, a molten material temperature (discharge temperature) was 1450° C. and a roller peripheral speed was 30 m/s. The liquid quenching was performed under an argon gas reduced pressure atmosphere. It was confirmed that the strip had nanocrystals according to observation under a transmission electron microscope (TEM).

The strip was roughly pulverized into powder, and the powder was inserted into a die and pressurized and heated to obtain a sintered material. As pressurizing and heating conditions, an applied pressure was 400 MPa, a heating temperature was 650° C., and a pressurizing and heating holding time was 60 seconds.

The sintered material was subjected to thermal upsetting processing (high temperature deformation) to obtain the rare earth magnet precursor 200 (plastically deformed component). As thermally upsetting processing conditions, a processing temperature was 750° C., and a strain rate was 0.1 to 10.0/s. It was confirmed that oriented nanocrystals were included in the plastically deformed component under a scanning electron microscope (SEM).

As the modifier, a $Nd_{70}Cu_{30}$ alloy was prepared. Nd powder and Cu powder (commercially available from Kojundo Chemical lab. Co., Ltd.) were weighed out, arc-melted, and liquid-quenched to obtain a strip.

The rare earth magnet precursor 200 (plastically deformed component) and the modifier (strip) were brought into contact with each other, and heated in a heating furnace. An amount of the modifier was 5.3 atom % (10 mass %) with respect to the rare earth magnet precursor 200. As the heating furnace, a lamp furnace (commercially available from ULVAC, Inc.) was used. As heat treatment conditions, a temperature in the heat treatment was 700° C., and a heat treatment time was 360 minutes.

(Preparation of sample of Example 2) A sample of Example 2 was prepared in the same manner as in Example 1 except that an alloy for preparing the rare earth magnet precursor 200 had a composition of $(Ce_{0.50}La_{0.50})_{12.47}Fe_{81.23}Cu_{0.20}B_{5.73}Ga_{0.37}$.

(Preparation of Sample of Comparative Example) A sample of a comparative example was prepared in the same manner as in Example 1 except that an alloy for preparing the rare earth magnet precursor 200 had a composition of $Ce_{12.47}Fe_{81.23}Cu_{0.20}B_{5.73}Ga_{0.37}$.

(Preparation of Sample of Reference Example)

A sample of a reference example was prepared in the same manner as in Example 1 except that an alloy for preparing the rare earth magnet precursor 200 had a composition of $Nd_{13.86}Fe_{79.91}Cu_{0.20}B_{5.66}Ga_{0.37}$.

(Evaluation)

The coercive force and magnetization of the samples of Examples 1 to 2, the comparative example, and the reference example were measured. Measurements were performed at normal temperature using a vibrating sample magnetometer (VSM) (commercially available from LakeShore).

Structures of the samples of Example 1 and the comparative example were observed under a scanning transmission electron microscope (STEM), and component analysis (EDX line analysis) was performed.

Figure 4:
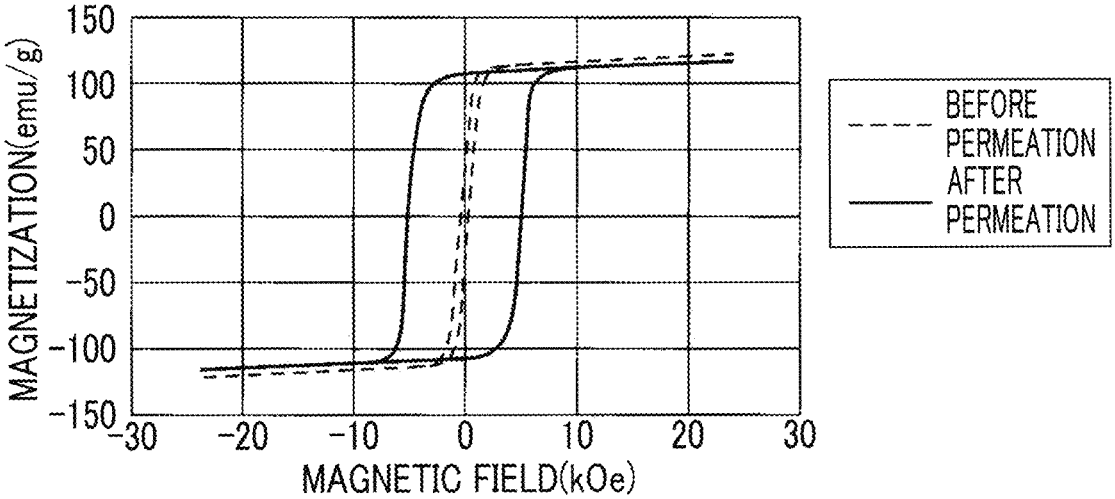
FIG. 4 is a diagram showing B-H curves of a sample of Example 1.
Figure 5:
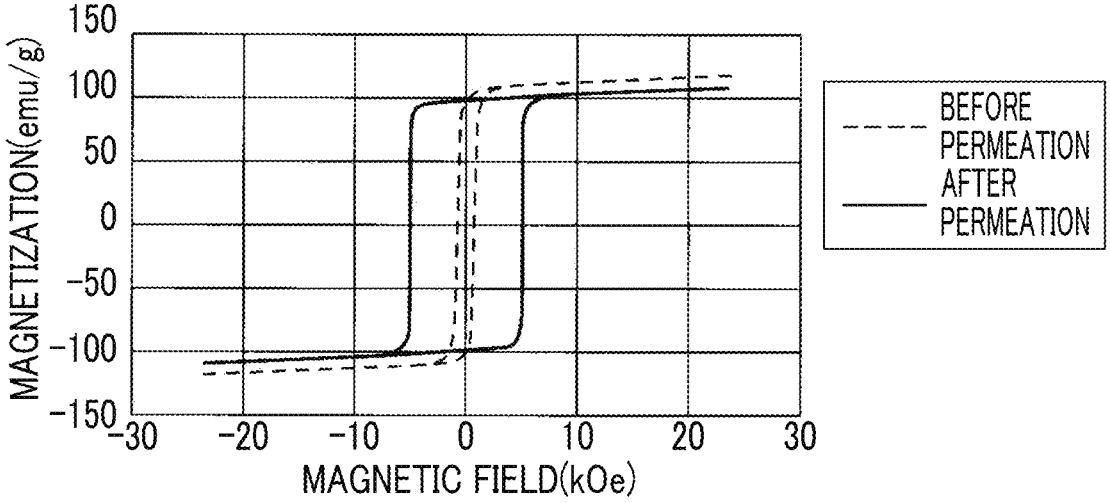
FIG. 5 is a diagram showing B-H curves of a sample of a comparative example.
Figure 6:
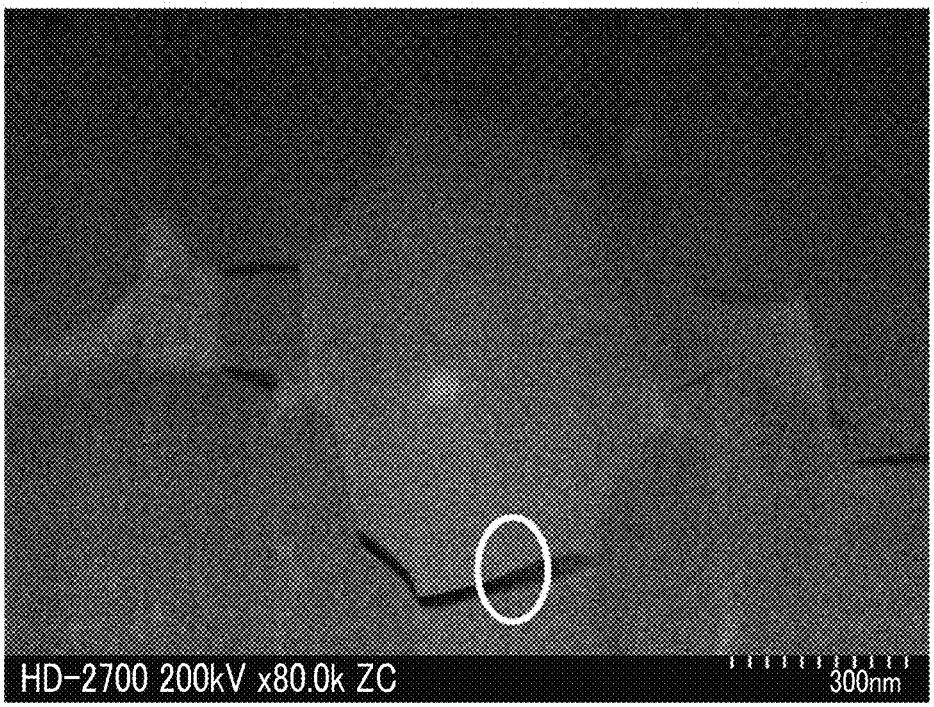
FIG. 6 is a diagram showing a scanning transmission electron microscope image of the sample of the comparative example.
Figure 7:
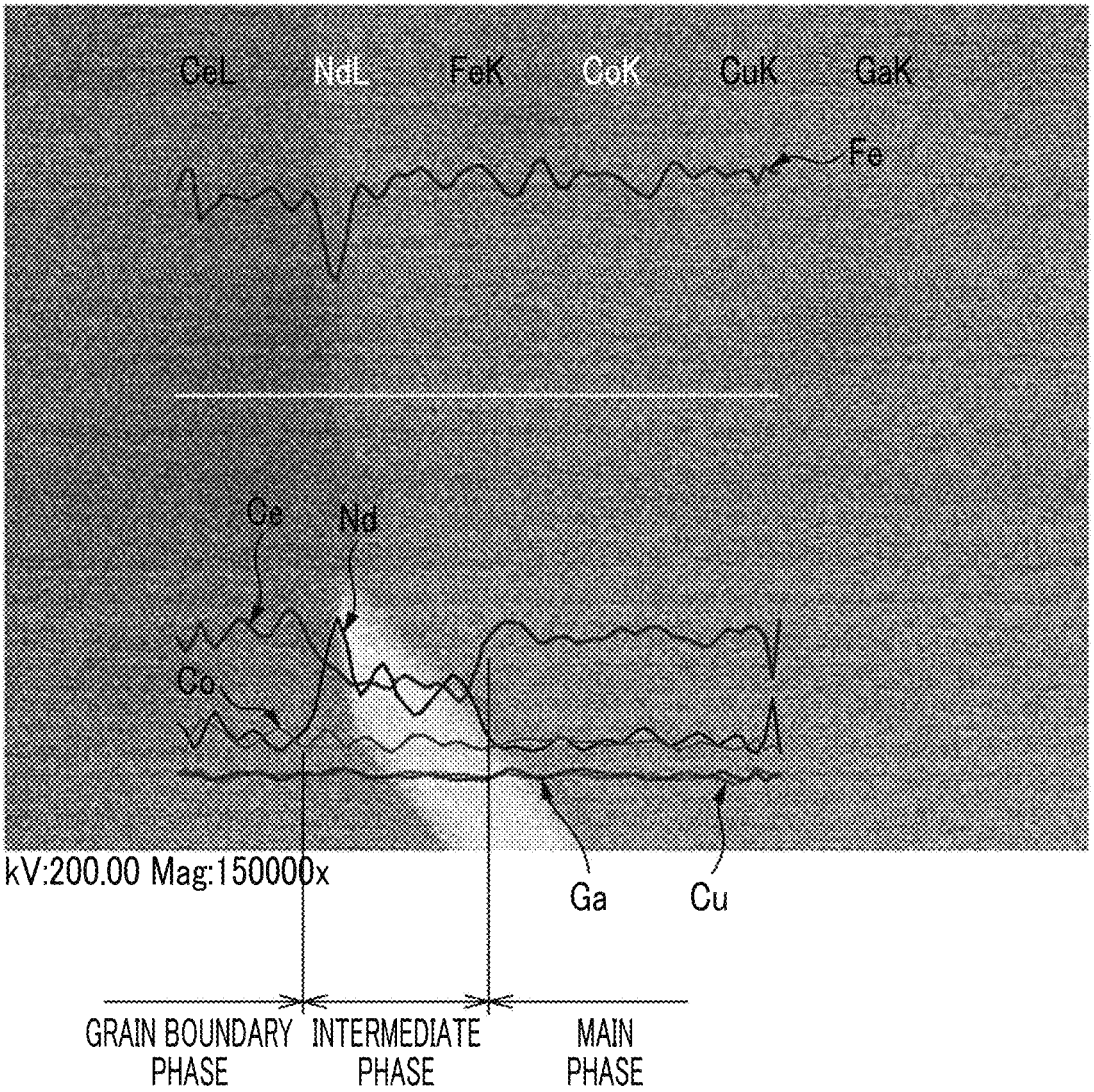
FIG. 7 is a diagram showing results obtained by component analysis of a part surrounded by the white line in FIG. 6.
Figure 8:
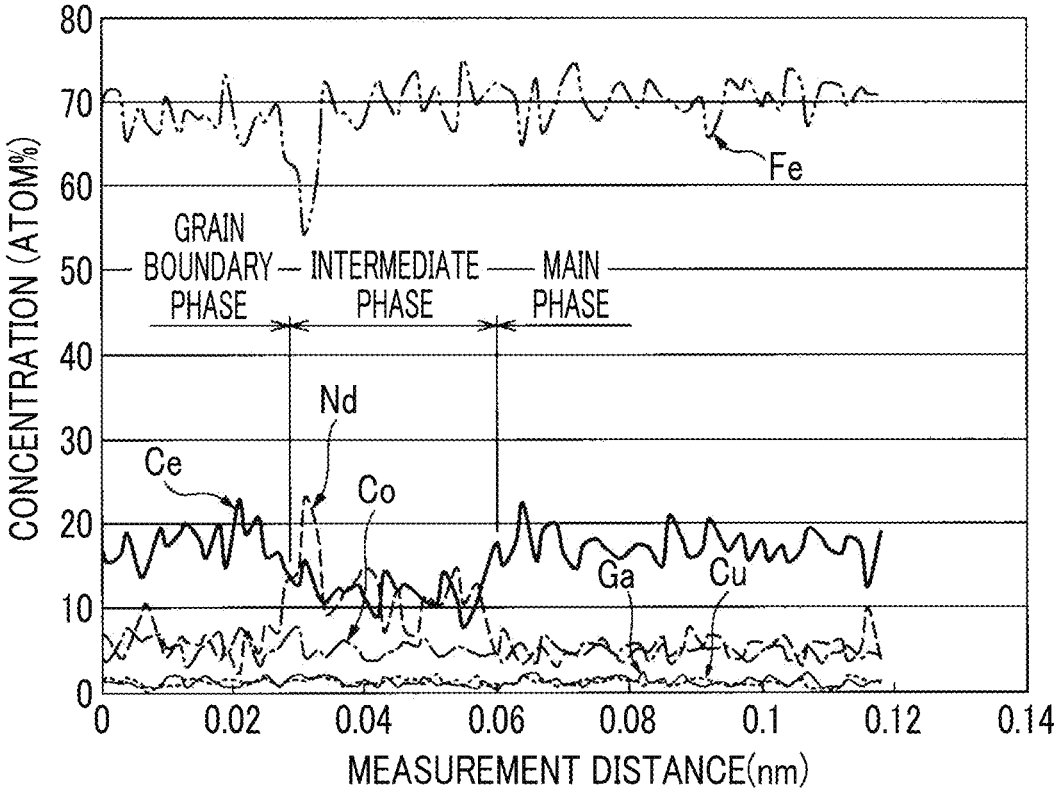
FIG. 8 is a diagram showing a summary of results in FIG. 7.

Evaluation results are shown in Table 1 and FIGS. 4 to 11. FIG. 4 is a diagram showing B-H curves (magnetic hysteresis curves) of the sample of Example 1. FIG. 5 is a diagram showing B-H curves (magnetic hysteresis curves) of the sample of the comparative example. FIG. 6 is a diagram showing a scanning transmission electron microscope (STEM) image of the sample of the comparative example. FIG. 7 is a diagram showing results obtained by component analysis (EDX line analysis) of a part surrounded by the white line in FIG. 6. In FIG. 7, the white straight line indicates a part on which EDX line analysis was performed. FIG. 8 is a diagram showing a summary of results in FIG.

Figure 9:
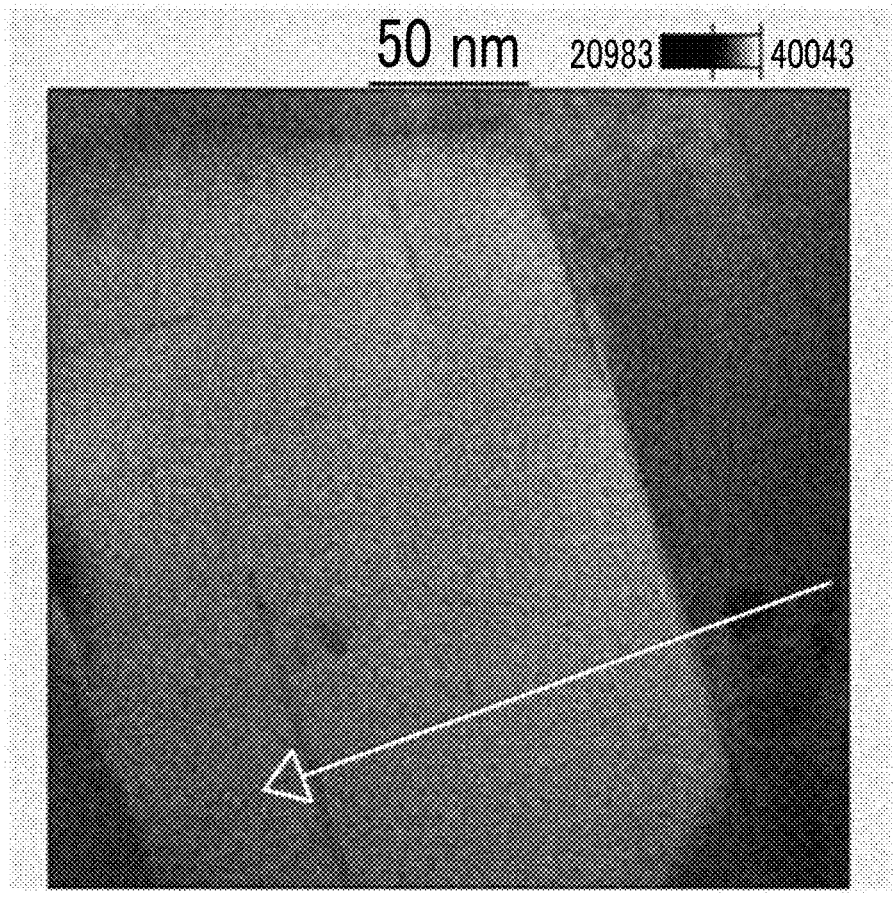
FIG. 9 is a diagram showing a scanning transmission electron microscope image of the sample of Example 1.
Figure 10:
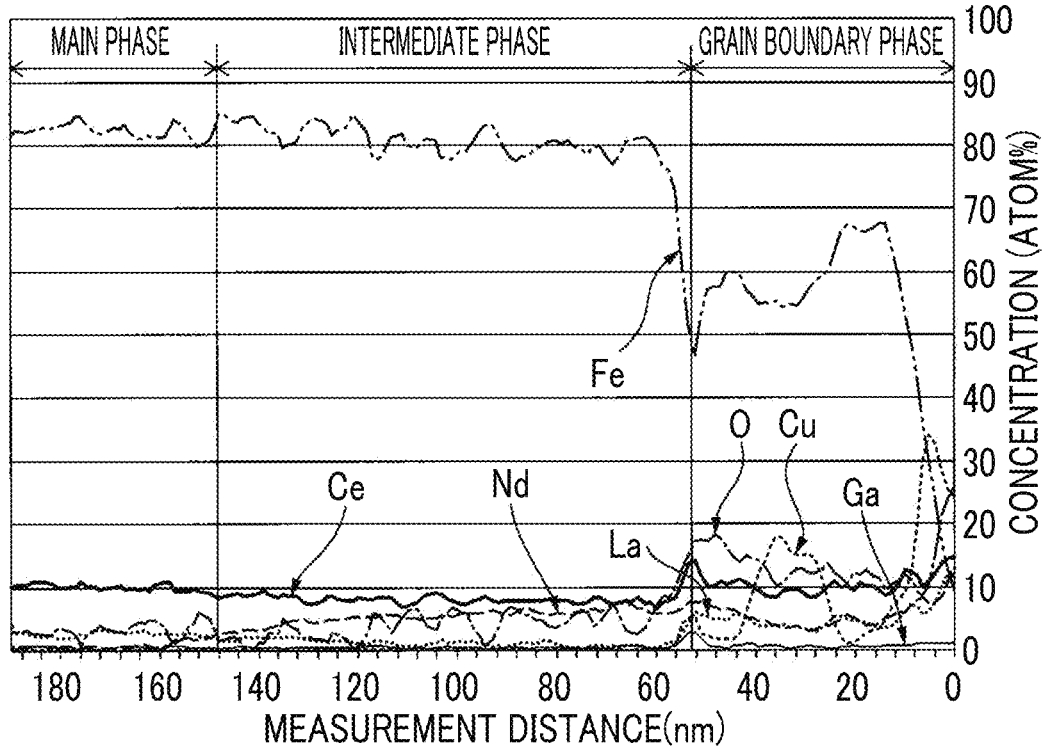
FIG. 10 is a diagram showing a summary of results of component analysis along the white arrow in FIG. 9.
Figure 11:
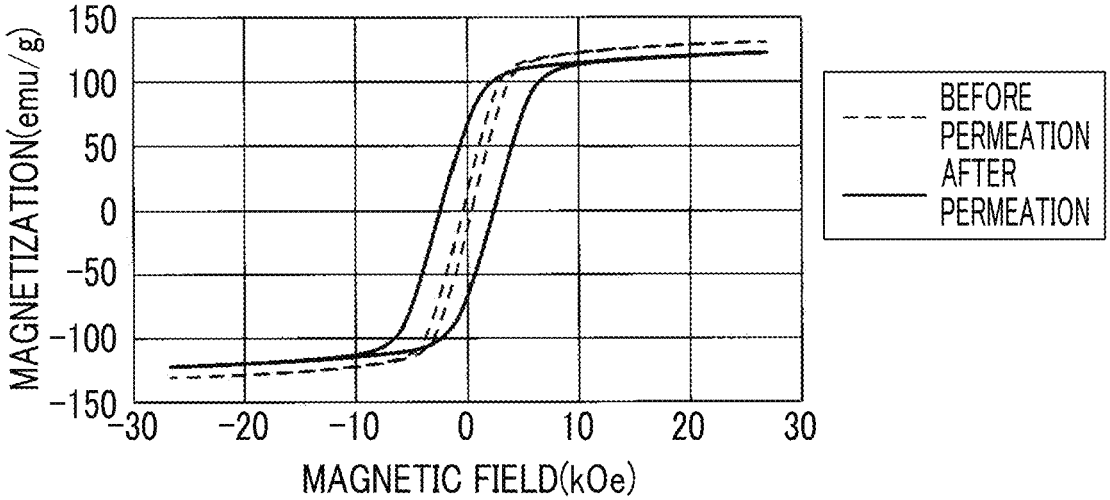
FIG. 11 is a diagram showing B-H curves of a sample of Example 2.

7. FIG. 9 is a diagram showing a scanning transmission electron microscope (STEM) image of the sample of Example 1. FIG. 10 is a diagram showing a summary of results of EDX line analysis along the white arrow in FIG. 9. FIG. 11 is a diagram showing B-H curves (magnetic hysteresis curve) of the sample of Example 2.

TABLE 1

| | Before permeation | | After permeation | | |
|---|---|---|---|---|---|
| | Coercive force (kOe) | Magnetization (emu/g) | Coercive force (kOe) | Magnetization (emu/g) | Magnetization reduction rate (%) |
| Example 1 | 0.40 | 121.66 | 5.10 | 116.09 | 4.58 |
| Example 2 | 0.41 | 130.66 | 2.41 | 122.36 | 6.35 |
| Comparative Example | 0.78 | 117.93 | 5.05 | 108.54 | 7.96 |
| Reference Example | 11.10 | 149.96 | 14.70 | 136.32 | 9.09 |

As can be understood from Table 1, it was confirmed that, in the samples of Examples 1 to 2, even if the coercive force was improved by causing permeation of a modifier, it was possible to prevent magnetization from being reduced.

As can be understood from FIGS. 6 to 8 regarding the comparative example, even if a rare earth element in the rare earth magnet was only Ce, a total concentration of Ce and La was higher in the main phase 10 than in the intermediate phase 30, and a concentration of Nd ($R^2$) was higher in the intermediate phase 30 than in the main phase 10.

On the other hand, the lattice stabilization energy of $La_2Fe_{14}B$ was lower than the lattice stabilization energy of $Ce_2Fe_{14}B$. Thus, in the sample of Example 1, when Ce and La were included together, mutual movement of Ce and La with respect to $R^2$ easily occurred, and it is thought that Nd ($R^2$) was replaced with La and/or Ce in $La_2Fe_{14}B$ and/or $Ce_2Fe_{14}B$. That is, when La was included, since mutual movement of Ce and La with respect to $R^2$ easily occurred, a concentration of Nd ($R^2$) was thought to be higher in the intermediate phase 30 than in the main phase 10. In addition, prevention of a reduction in magnetization that was confirmed in Table 1 was thought to be caused by replacement of Nd ($R^2$) with La and/or Ce.

When Ce and La were included together in the rare earth magnet 100, concentrations of Ce, La, and Nd ($R^2$) in the main phase 10, the grain boundary phase 20, and the intermediate phase were confirmed as follows in FIG. 10. That is, a total concentration of Ce and La was higher in the main phase 10 than in the intermediate phase 30. In addition, a concentration of $R^2$ was higher in the intermediate phase 30 than in the main phase 10. Further, a concentration of La was higher in the grain boundary phase 20 than in the intermediate phase 30. Thus, a concentration of La in the grain boundary phase 20 was 1.5 to 10.0 times as high as that in the intermediate phase 30. This is because, since the lattice stabilization energy of $La_2Fe_{14}B$ was lower than the lattice stabilization energy of $Ce_2Fe_{14}B$, any $La_2Fe_{14}B$ was thought to be hardly included in the main phase 10 and the intermediate phase 30, and La moved to the grain boundary phase 20.

Based on the above results, the effects of the present disclosure were confirmed.

What is claimed is:

1. A rare earth magnet comprising:

a main phase;

a grain boundary phase present around the main phase; and an intermediate phase interposed between the main phase and the grain boundary phase, wherein the rare earth magnet has an overall composition represented by $((Ce_{(1-x)}La_x)_{(1-y)}R^1_y)_pT_{(100-p-q-r)}B_qM^1_r(R^2_{1-z}M^2_z)_s$, where $R^1$ and $R^2$ are rare earth elements other than Ce and La, T is at least one selected from among Fe, Ni, and Co, $M^1$ is at least one selected from among Ti, Ga, Zn, Si, Al, Nb, Zr, Mn, V, W, Ta, Ge, Cu, Cr, Hf, Mo, P, C, Mg, Hg, Ag, and Au, and first inevitable impurities, $M^2$ is (i) an alloy element for which a melting point of $R^2_{1-z}M^2_z$ is lower than a melting point of $R^2$ when $M^2$ is alloyed with $R^2$ and (ii) second inevitable impurities, and p, q, r, s, x, y, and z satisfy $12.0 \le p \le 20.0$, $5.0 \le q \le 20.0$, $0 \le r \le 3.0$, $1.0 \le s \le 11.0$, $0.1 \le x \le 0.5$, $0 \le y \le 0.1$, and $0.1 \le z \le 0.5$, wherein a total concentration of Ce and La is higher in the main phase than in the intermediate phase, wherein a concentration of $R^2$ is higher in the intermediate phase than in the main phase, and wherein a concentration of La is higher in the grain boundary phase than in the intermediate phase.

2. The rare earth magnet according to claim 1, wherein $R^2$ is at least one selected from among Nd, Pr, Dy, and Tb.

3. The rare earth magnet according to claim 1, wherein the total concentration of Ce and La in the main phase is 1.5 to 10.0 times as high as that in the intermediate phase.

4. The rare earth magnet according to claim 1, wherein the concentration of $R^2$ in the intermediate phase is 1.5 to 10.0 times as high as that in the main phase.

5. The rare earth magnet according to claim 1, wherein a concentration of La in the grain boundary phase is 1.5 to 10.0 times as high as that in the intermediate phase.

6. The rare earth magnet according to claim 1, wherein x satisfies $0.2 \le x \le 0.3$.

7. The rare earth magnet according to claim 1, wherein z satisfies $0.2 \le z \le 0.4$.

8. The rare earth magnet according to claim 1, wherein a thickness of the intermediate phase is 5 to 50 nm.

9. The rare earth magnet according to claim 1, wherein T is Fe.

10. A method of producing a rare earth magnet comprising:

preparing a rare earth magnet precursor which has an overall composition represented by $((Ce_{(1-x)}La_x)_{(1-y)}R^1_y)_pT_{(100-p-q-r)}B_qM^1_r$, where $R^1$ is a rare earth element other than Ce and La, T is at least one selected from among Fe, Ni, and Co, $M^1$ is at least one selected from among Ti, Ga, Zn, Si, Al, Nb, Zr, Mn, V, W, Ta, Ge, Cu, Cr, Hf, Mo, P, C, Mg, Hg, Ag, and Au, and first inevitable impurities, p, q, r, x and y satisfy $12.0 \le p \le 200.0$, $5.0 \le q \le 20.0$, $0 \leq r \leq 3.0$, $0.1 \leq x \leq 0.5$, and $0 \leq y \leq 0.1$, and which includes a magnetic phase and a (Ce, La, $R^1$)-rich phase present around the magnetic phase;

preparing a modifier containing an alloy represented by $R^2_{1-z}M^2_z$, where $R^2$ is the rare earth element other than Ce and La, $M^2$ is (i) an alloy element for which a melting point of $R^2_{1-z}M^2_z$ is lower than a melting point of $R^2$ when it is alloyed with $R^2$ and (ii) second inevitable impurities, and $0.1 \leq z \leq 0.5$;

bringing the rare earth magnet precursor and the modifier into contact with each other to obtain a contact body; and heating the contact body such that a liquid which is the melted modifier is permeated into the magnetic phase of the rare earth magnet precursor in a heat treatment, wherein a concentration of La is higher in a grain boundary phase than in an intermediate phase that is interposed between a main phase and the grain boundary phase.

11. The method of producing a rare earth magnet according to claim 10, wherein $R^2$ is at least one selected from among Nd, Pr, Dy, and Tb; and $M^2$ is at least one selected from among Cu, Al, and Co, and inevitable impurities.

12. The method of producing a rare earth magnet according to claim 10, wherein z satisfies $0.2 \leq z \leq 0.4$.

13. The method of producing a rare earth magnet according to claim 10, wherein a permeation amount of the modifier is 1.0 to 11.0 atom % with respect to the rare earth magnet precursor.

14. The method of producing a rare earth magnet according to claim 10, wherein a temperature in the heat treatment is 600 to 800° C.

15. The method of producing a rare earth magnet according to claim 10, wherein x satisfies $0.2 \leq x \leq 0.3$.

16. The method of producing a rare earth magnet according to claim wherein

T is Fe.

* * * * *